US006488179B1

(12) United States Patent
Vujicic et al.

(10) Patent No.: US 6,488,179 B1
(45) Date of Patent: Dec. 3, 2002

(54) DISPOSABLE ASEPTIC CASSETTE WITH CONTROL CENTER

(76) Inventors: Zoran Vujicic, 255 Skyline Dr., Hollister, CA (US) 95023; Sheila Wilke, 255 Skyline Dr., Hollister, CA (US) 95023

( * ) Notice: Subject to any disclaimer, the term of this patent is extended or adjusted under 35 U.S.C. 154(b) by 0 days.

(21) Appl. No.: 10/006,159

(22) Filed: Nov. 12, 2001

(51) Int. Cl.[7] ..... B67D 5/60

(52) U.S. Cl. ..... 222/132; 222/146.5; 222/325; 222/333

(58) Field of Search ..... 222/132, 146.5, 222/325, 333

(56) References Cited

U.S. PATENT DOCUMENTS 4,133,456 A * 1/1979 Corini ..... 222/146.5
4,487,337 A * 12/1984 DeJardins ..... 222/132
5,096,092 A * 3/1992 Devine ..... 222/325
5,490,614 A * 2/1996 Sardynski ..... 222/132

* cited by examiner

*Primary Examiner*—Philippe S Derakshani
(74) *Attorney, Agent, or Firm*—Jeffrey A. Hall

(57) ABSTRACT

A disposable aseptic cassette control device, for controlled dispensing and heating of flowable and semi-flowable materials includes a base, having a top portion, a bottom portion, a back portion, and a front portion. The base has a container portion, and power receiving mechanism for receiving power from a power source. A plurality of aseptic cassettes are operably mounted and positioned in the base and include a dispensing mechanism for dispensing flowable or semi-flowable material. Controls for turning the heating and dispensing device on and off, and for controlling the temperature and pressure within the plurality of aseptic cassettes are positioned on the base.

6 Claims, 2 Drawing Sheets

DISPOSABLE ASEPTIC CASSETTE WITH CONTROL CENTER

BACKGROUND OF THE INVENTION

1. Field of Invention

This invention relates to heating elements for heating food and other products, and more particularly to a heating unit having a control center with a plurality of disposable aseptic cassettes positioned operably for the controlled heating and dispensing of food, or other flowable or semi-flowable substances.

2. Description of the Related Art

Various devices have been proposed and implemented for heating food and other flowable substances, such as glue, hot cleaners, chemicals, and the like. Although numerous devices exist for such purposes, none provide for a simple, easily controlled device for the sanitary dispensing and heating of food products such as cheese sauce, chili sauce, liquids and semi-liquids, and the like, as well as other flowable substances. The present invention provides a mechanism for rapidly heating and dispensing such items using multiple cassettes in a safe and sanitary way. If desired, the present invention may also be used to dispense cold or processed foods or other substances which it is not necessary to heat, such as ketchup, mustard, dressings, and the like.

Accordingly, it is the primary object of this invention to provide an efficient, sanitary, and conveniently used device for the controlled dispensing of heated, non-heated, or cold forms of various foods and other flowable substances.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims.

SUMMARY OF THE INVENTION

To achieve the foregoing objects, and in accordance with the purpose of the invention as embodied and broadly described herein, a disposable aseptic cassette control device is provided, for controlled dispensing heated, non- heated, or cold flowable and semi-flowable substances. The device includes a base, having a top portion, a bottom portion, a back portion, and a front portion. The base has a container portion, a air compressor mechanism, and a power receiving mechanism for receiving power from a power source. A plurality of aseptic cassettes are operably mounted and positioned on the base and include a dispensing mechanism for dispensing flowable or semi-flowable materials. Automatic or manual controls for turning the heating and dispensing device "on" and "off", and for controlling the temperature within the plurality of aseptic cassettes are positioned on the base element.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Reference will now be made in detail to the present preferred embodiments of the invention as illustrated in the accompanying drawings.

In accordance with the present invention, there is provided in a preferred embodiment of the invention, a disposable aseptic cassette control device, for controlled and sanitary dispensing and heating of flowable and semi-flowable materials. The device includes a base, having a top portion, a bottom portion, a back portion, and a front portion. The base has a container portion, a air compressor mechanism, and a power receiving mechanism for receiving power from a power source. A plurality of aseptic cassettes are operably mounted and positioned on the base and include a dispensing mechanism for dispensing flowable or semi-flowable material. Controls for turning the heating and dispensing device on and off, and for controlling the temperature within the plurality of aseptic cassettes are positioned on the base.

Figure 1:
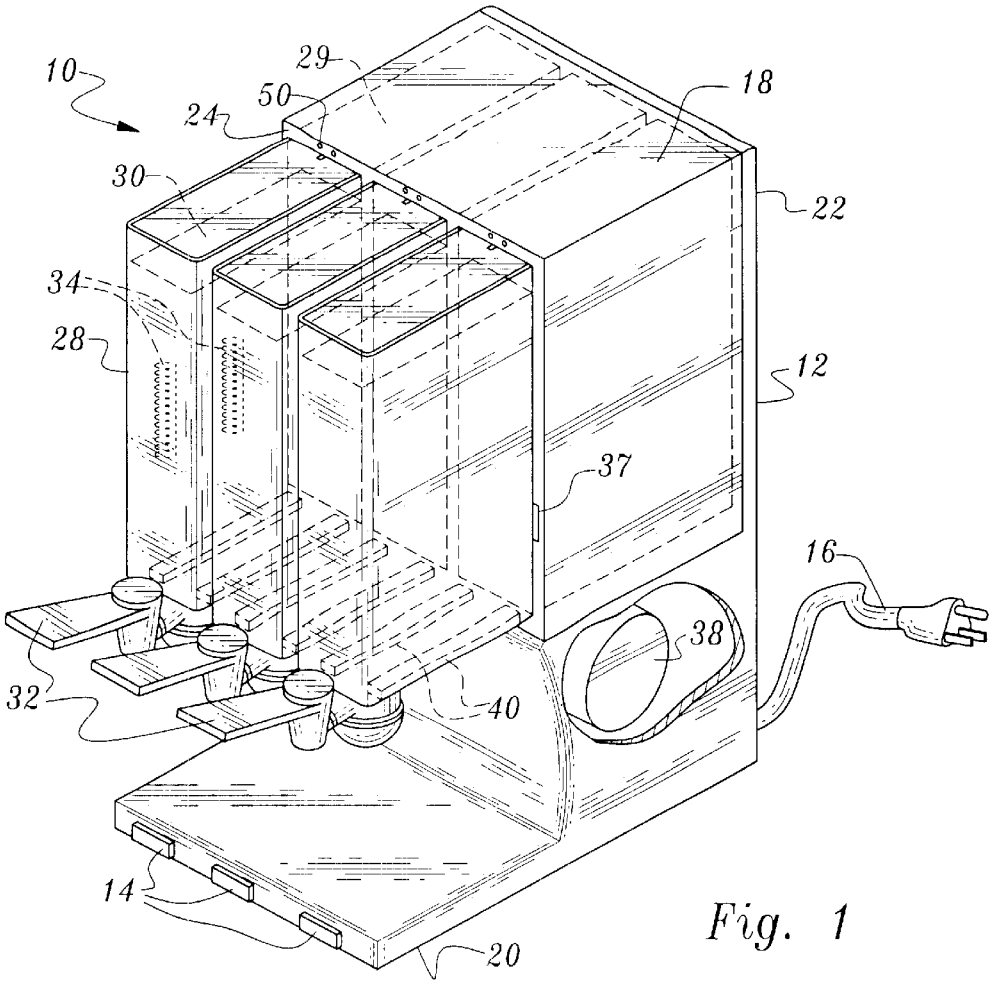
FIG. 1 is a perspective view of a disposable aseptic cassette control center, according to the invention.

In FIG. 1, a disposable aseptic cassette control device 10, is shown according to a preferred embodiment of the invention. Disposable aseptic cassette control device 10, includes a base 12, having a top portion 18, a bottom portion 20, a back portion 22, and a front portion 24. Base 12, also has a container portion which houses air compressor means, such as air compressor 38. Power receiving means, such as electric cord 16, which may be a US or international detachable magnetic cord, are operably secured to base 12, for receiving power from a power source.

A plurality of cassettes, preferably aseptic cassettes 28, composed of an non-flexible material such as plastic, are operably positioned in cassette houses 29, and are attached to base 12. Preferably, each cassette includes an air nozzle 36. One way valve for air pressure control 37, is preferably positioned on base 12. One or more heating elements 34, are operably positioned in cassette 30, and may be controlled by control means such as control panel 14, with a plurality of dispensing controls and indicator LED's for indicating when fluid within the cassette is at a selected temperature.

Cassette houses 29, of aseptic cassettes 28, preferably include an automatic dispensing mechanism 32, preferably with a handle, for dispensing flowable or semi-flowable substances from the cassettes. It is also seen in FIG. 1, a rail support 40, in cassettes 28, for supporting cassettes 28, when inserted into cassette housing 29. Preferably the cassettes are separated from each other by plastic, rubber or other durable resilient material.

Figure 2:
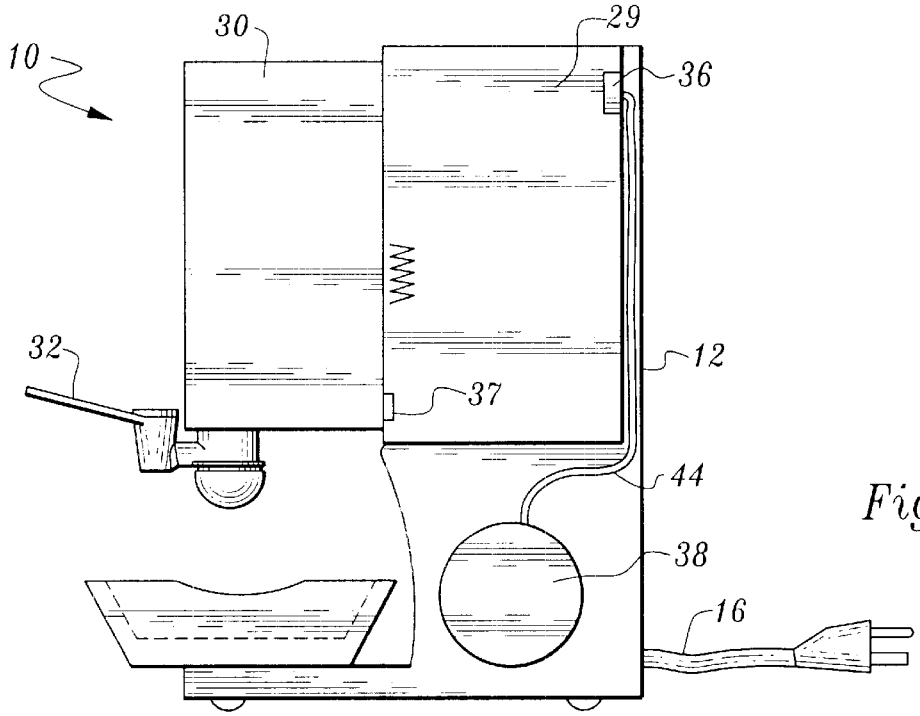
FIG. 2 is a schematic view of such disposable aseptic cassette control center, according to the invention.

With reference now to FIG. 2, tubing 44 from air compressor 38, allows air to be transmitted to cassettes 28. Sensor means, such as signal display 50, is used for detecting the temperature of one or more heating elements 34, within the cassettes. Dispensing valve mechanism 32, is preferably provided as shown, but may be otherwise. A valve 37, which may be a solenoid valve or similar type of valve, operably links cassette 28 to base 12.

Figure 3:
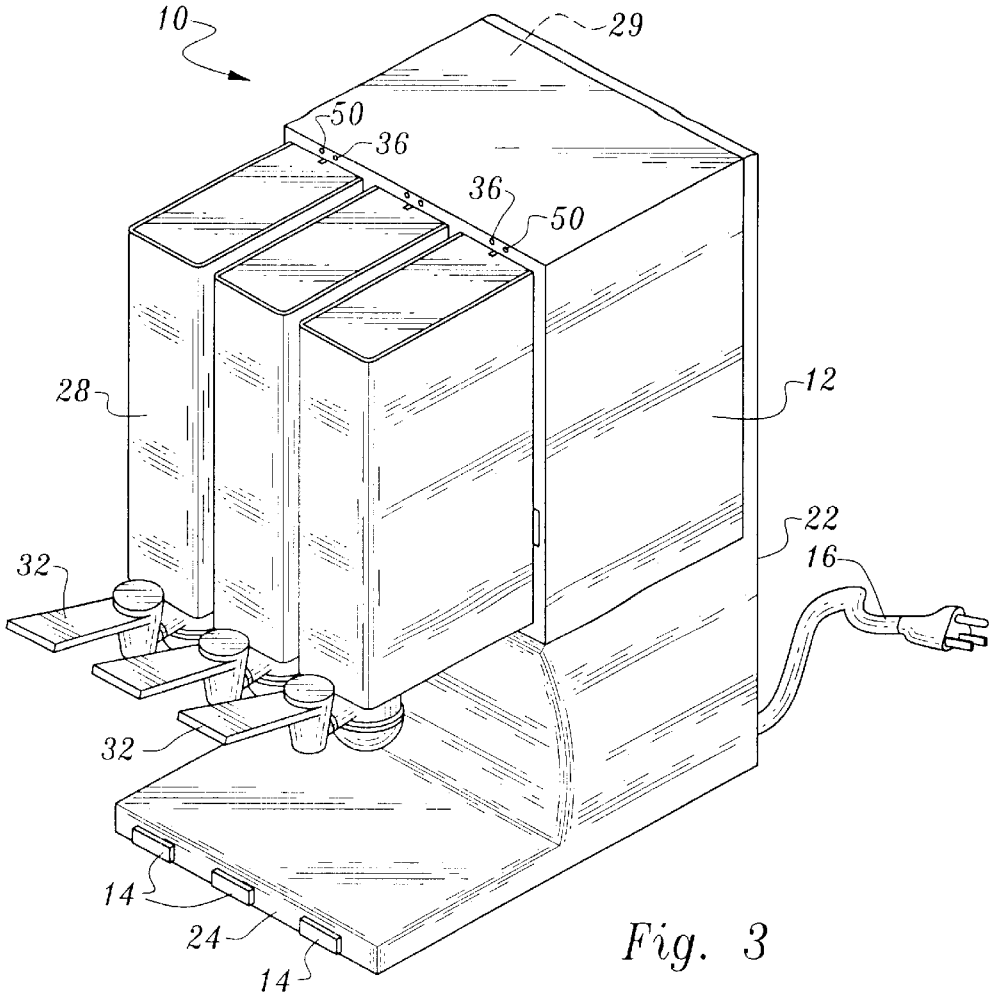
FIG. 3 is a perspective view showing the control panel and dispensing valves of an embodiment of the disposable aseptic cassette control center, according to the invention.

Referring now to FIG. 3, the disposable aseptic cassette control center 10, with aseptic cassettes 28, is shown.

Preferably, temperature display or control means 50, is operably positioned above cassette 28. Air nozzle 36, is shown in FIG. 2. Temperature display or control means 50, may be used to display or sense heat inside the cassette. Control means 14, for On/Off control, temperature, voltage, pressure, and the like, are conveniently positioned on base 12. Control means 14, may comprise a panel with buttons, or individually positioned buttons or switches on base 12, for control of the above mentioned functions. Temperature sensors may be operably linked to the digital display and positioned on the sides of the cassettes, on top of the cassettes, or otherwise.

Figure 4:
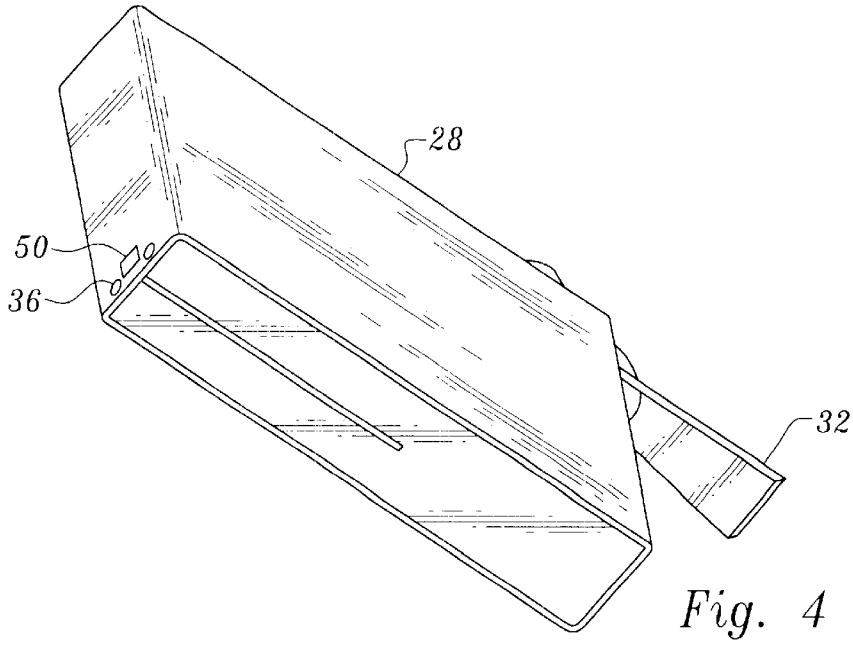
FIG. 4, shows a disposable aseptic cassette removed from the control center housing, according to the invention.

In FIG. 4, an aseptic disposable cassette 28, is shown removed from base 12. After use, cassette 28, may be removed from base 12, and discarded along with dispensing mechanism, such as valve 32. A new cassette or cassettes may then be slid into base 14, and used for the same or different products. This allows for a very easy, convenient, and efficient means to heat and dispense flowable and semi-flowable foodstuffs and other materials.

In operation and use, the disposable aseptic cassette control center of the present invention is easy and quick to install, reliable, efficient, is less expensive to manufacture than prior systems for heating, cooling, and/or dispensing flowable and semi-flowable material, and may used with a wide variety of flowable and semi-flowable substances. The unique advantages of the present device include the ability to heat up internally and almost instantly a wide variety of flowable and semi-flowable substances rapidly and in a sanitary manner. The device of the present invention may also be used with flowable and semi-flowable substances which do not require heating prior to disposal.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A disposable aseptic cassette control device, for controlled dispensing and heating of flowable and semi-flowable materials, comprising:

a base, said base having a top portion, a bottom portion, a back portion, and a front portion, said base having a container portion, and power receiving means for receiving power from a power source;

a plurality of non-flexible aseptic cassettes, said plurality of aseptic cassettes being operably mounted and positioned on said base and include dispensing means for dispensing flowable or semi-flowable material, said plurality of non-flexible aseptic cassettes each contain one or more heating element means for heating flowable or semi-flowable material within said aseptic cassettes; and control means, for controlling the temperature within said plurality of aseptic cassettes.

2. The disposable aseptic control device of claim 1, wherein said base further includes signal detector means for detecting the temperature of one or more heating elements within said plurality of aseptic cassettes.

3. The disposable aseptic control device of claim 1, wherein each of said plurality of non-flexible aseptic cassettes has a dispensing chamber and a pressurized chamber, said dispensing chamber and said pressurized chamber being operably linked to each other.

4. A controlled dispensing and heating device for flowable and semi-flowable materials, comprising:

a base, said base having a top portion, a bottom portion, a back portion, and a front portion, and power receiving means for receiving power from a power source;

a plurality of cassettes, said plurality of cassettes being operably mounted and positioned on said base and include dispensing means for dispensing flowable or semi-flowable material, said plurality of cassettes each contain one or more heating element means for heating flowable or semi-flowable material within said cassettes, and control means, for controlling the temperature within said plurality of cassettes.

5. The controlled dispensing and heating device of claim 4, wherein said heating element means in each of said plurality of cassettes is a heating element for heating flowable or semi-flowable material within said cassettes.

6. The dispensing and heating device of claim 4, wherein each of said plurality of cassettes has a dispensing chamber and a pressurized chamber, and said dispensing chamber being operably linked to each other.

* * * * *

UNITED STATES PATENT AND TRADEMARK OFFICE

CERTIFICATE OF CORRECTION

PATENT NO. : 6,488,179 B1
DATED : December 2, 2002
INVENTOR(S) : Vujicic et al.

It is certified that error appears in the above-identified patent and that said Letters Patent is hereby corrected as shown below:

Title page,
Item [76], Inventors, after "95023;" add -- Mark Taskar, 1658 DeAnza Blvd., San Mateo, CA. 94403 --.

Signed and Sealed this

Fifth Day of August, 2003

JAMES E. ROGAN
*Director of the United States Patent and Trademark Office*